United States Patent [19]

Rasmussen

[11] 4,055,737

[45] Oct. 25, 1977

[54] TERMINAL BLOCK ASSEMBLY FOR MOUNTING A SWITCH OR OTHER ELECTRICAL COMPONENT

[75] Inventor: Harry R. Rasmussen, Tacoma, Wash.

[73] Assignee: Crest Industries, Inc., Puyallup, Wash.

[21] Appl. No.: 645,825

[22] Filed: Dec. 31, 1975

[51] Int. Cl.[2] ..... H01H 9/02

[52] U.S. Cl. ..... 200/51 R; 339/242; 174/59; 200/295; 361/426

[58] Field of Search ..... 317/112, 120; 200/51 R, 200/51.02, 153 G, 302, 293, 294, 339; 174/59, 153 G; 339/198 R, 198 N, 242; 361/331, 332, 350, 357, 426

[56] References Cited

U.S. PATENT DOCUMENTS

| | | | |
|---|---|---|---|
| 2,908,743 | 10/1959 | Premoshis | 174/59 |
| 3,018,464 | 1/1962 | Mrenna | 339/242 |
| 3,639,716 | 2/1972 | Rasmussen | 200/294 |
| 3,694,701 | 9/1972 | Stanback | 174/59 |

*Primary Examiner*—Gerald P. Tolin
*Attorney, Agent, or Firm*—Christensen, O'Connor, Garrison & Havelka

[57] ABSTRACT

The assembly includes a dielectric base having molded structural portions for receiving and mounting a manually operated switch, and for receiving and mounting a plurality of electrical connection terminals that serve to connect lead wires to the switch contacts. The switch contacts and electromechanical switching mechanism are mounted in a preassembled switch body, from which a plurality of substantially rigid electrical connection prongs extend. The base includes a honeycomb-like cluster of terminal receiving recesses and a plurality of prong receiving apertures, one for each recess. The prong receiving apertures extend inwardly of the base from a surface thereof defining a recess for seating the body of the switch, with each aperture opening into a separate one of the terminal receiving recesses through an interior recess sidewall. The recesses, apertures and switch prongs are cooperatively formed and disposed so that the switch prongs are insertable through the apertures to protrude into the terminal receiving recesses when the switch body is seated on the base. An electrical connection terminal means is positionable in each terminal receiving recess for mechanically gripping and electrically contacting the prong that resides therein thereby securing the switch component to the base. These terminal means also serve to detachably connect a lead wire to the associated switch prong.

35 Claims, 11 Drawing Figures

TERMINAL BLOCK ASSEMBLY FOR MOUNTING A SWITCH OR OTHER ELECTRICAL COMPONENT

BACKGROUND OF THE INVENTION

The present invention relates to a device for mechanically mounting an electrical switch, or other similar electrical component, and in which the device includes electrical terminals for connecting lead wires to the switch. An example of such a switch and terminal block assembly is disclosed in my prior U.S. Pat. No. 3,639,716 issued on Feb. 1, 1972. As disclosed therein, the assembly is particularly useful as a "transfer switch" in the telephone switching art and is typically embodied in a compact, miniaturized unit, suitable for attachment to the side of a telephone instrument, and having a manually operated switch for selectively transferring telephone calls from one instrument location to another.

Because of the numerous telephone installations in which such transfer switches are utilized, they are manufactured in substantial numbers, and the cost thereof to the user depends largely on the ability of the producer to mass manufacture the assembly at a relatively low, per unit, cost. The individual non-assembled components are already mass manufactured, efficiently, by automated machinery; however the time required to assemble the components has heretofore resulted in a per unit cost that is excessive relative to the costs of the components because of the assembly labor time.

SUMMARY OF THE INVENTION AND ITS OBJECTIVES

Accordingly, it is an object of the present invention to provide a terminal block assembly for mounting a manually operated switch or other electrical component and for making electrical connections to such component, in which the various parts of each unit are quickly and easily assembled to minimize the labor cost. A related object of the present invention is to provide such an assembly in which the parts therefor can be mass produced at a low, per unit cost, and in which the completed assembly: is quickly and easily installed; provides long lasting, trouble free operation; and is of rugged, abuse resistant construction.

Briefly, these objects are achieved in a terminal block assembly including a dielectric base having structural portions for receiving and mounting a manually operated switch or other electrical component in which such switch or component includes a body and one or more substantially rigid electrical connection prongs extending from such body. The base structural portions define one or more terminal receiving recesses, one for each switch body prong, and one or more prong receiving apertures extending into the base and opening into separate ones of the terminal receiving recesses. The switch prongs are insertable through the apertures to protrude into the terminal receiving recesses. An electrical terminal connection means, adapted for receiving lead wire, is positionable in each recess for mechanically gripping and electrically contacting the prong residing therein. The assemblying of the foregoing parts accomplishes the multiple purposes of electrically connecting the wire receiving terminal to the switch prong and mechanically securing the switch component to the base. Installation of the assembly merely entails the attachment of one or more lead wires to the previously mounted terminals.

Usually, the switch component will be provided with cluster of prongs, extending from the body in spaced apart parallelism, with the base formed to have a corresponding cluster of terminal receiving recesses. In such case, the recesses and prong receiving apertures are cooperatively arranged with respect to the switch prongs to maintain electrical isolation between the prongs, terminals and lead wires connected thereto.

Such an assembly, when constructed in accordance with the disclosure set forth herein, has permitted an increase in productivity (reduction in the manufacturing cost per unit) of approximately five fold.

These and further features, objects and various advantages of the present invention will become apparent to those skilled in the art from a consideration of the following detailed description and appended drawings of particular, exemplary embodiments thereof.

DESCRIPTION OF THE PREFERRED EMBODIMENTS

Figure 5:
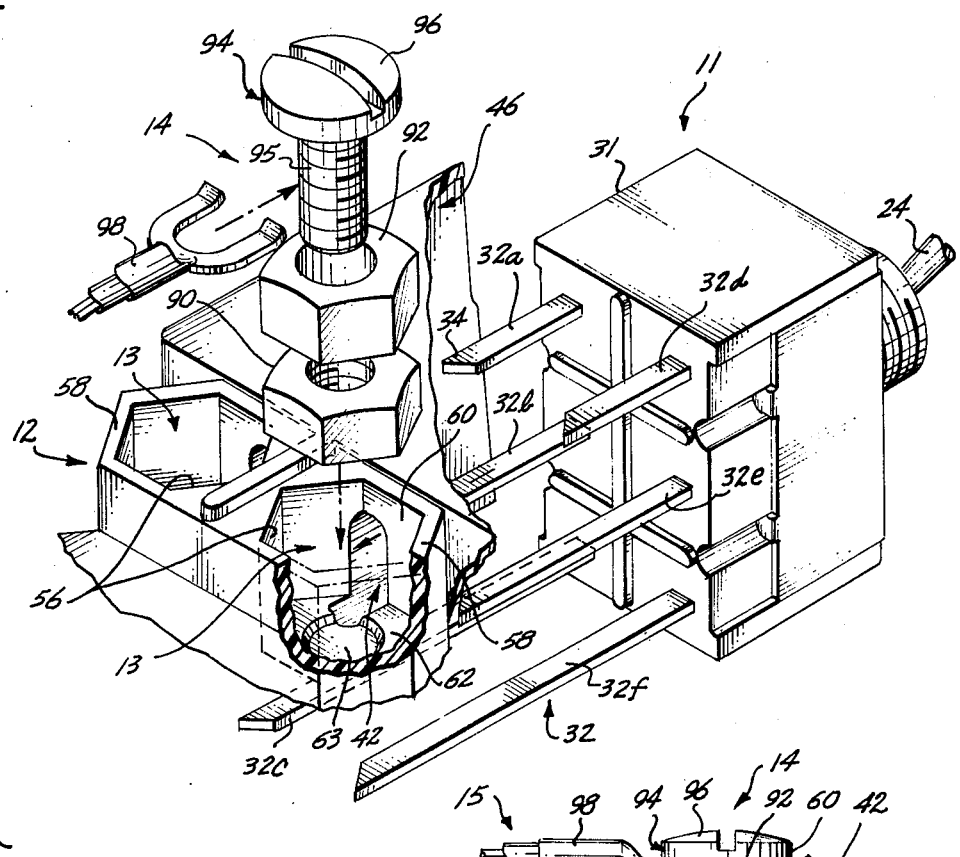
FIG. 5 is an exploded view of the assembly showing the electro-mechanical switch that is mounted on the base, one of the electrical terminals that cooperates with the base and switch prongs, and fragments of the base of FIGS. 1–4.
Figure 6:
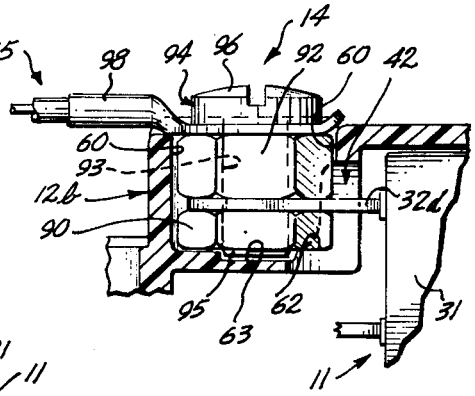
FIG. 6 is a detail view, partly in section, of one of the terminals mounted in a recess in the base and mechanically and electrically gripping one of the switch prongs.
Figure 7:
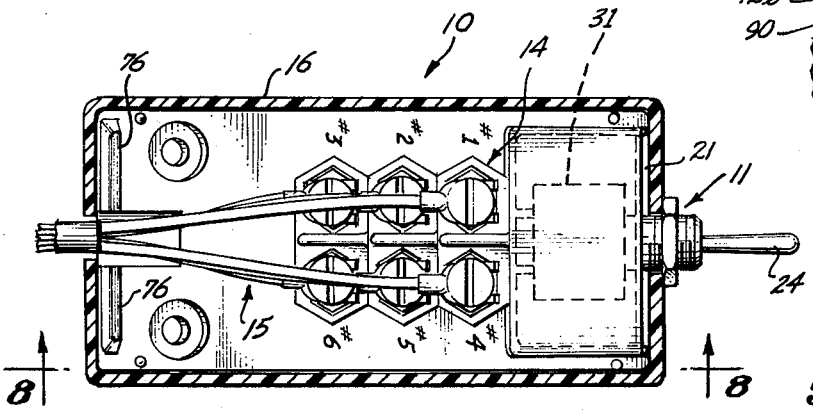
FIG. 7 is a top plan view of a completed assembly, with a cover for the assembly cut away to expose the arrangement of the switch, base, and terminals, and to illustrate the manner in which the lead wires and associated wire lugs are removably connected to the terminals of the assembly.

With reference to FIGS. 1–8, one of the embodiments of the present invention takes the form of an assembly 10 (FIGS. 7 and 8) that includes: an electro-mechanical toggle switch component 11 (FIG. 5); a dielectric base 12 having a plurality of terminal receiving recesses 13 (FIGS. 1–4); and a corresponding number of electrically conductive terminals 14 mounted in recesses 13 (FIGS. 5 and 6). Base 12 and terminals 13 together form a terminal block uniquely adapted for not only mechanically mounting component 11 but also providing terminals for detachably connecting lead wires to the electrical contacts of component 11.

Figure 8:
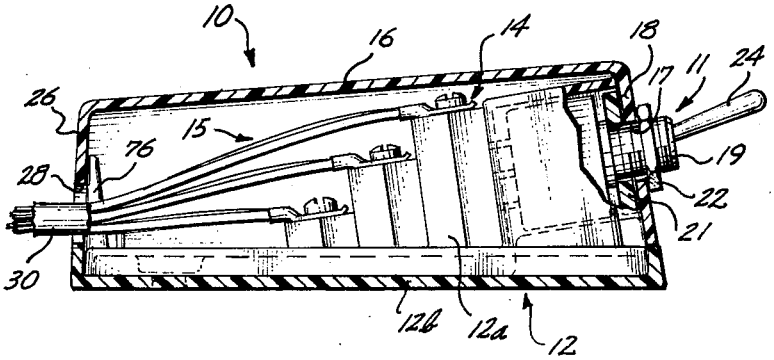
FIG. 8 is a cross sectional view of the completed assembly taken generally along section lines 8—8 in FIG. 7.

The individual parts of the assembly are each capable of being mass manufactured at a low, per unit cost, and they can be assembled together quickly, reliably and without requiring special skills. When assembled, the unit is ready for installation in the field which entails mounting of base 12 to a suitable support, such as the side of a telephone, and connecting lead wires 15 and associated lugs to the previously mounted terminals 14. Finally, a cover 16, complemental to base 12, is fitted over the base and secured in place as best shown in FIG. 8. With further reference to FIG. 8, the cover 16 is secured in place by the provision of an aperture 17 in an endwall 18 of cover 16 through which a threaded stem 19 of the previously mounted switch component 11, protrudes. The cover 16 is removably secured to stem 19, by means of a nut 22, threaded on stem 19 adjacent the outside surface of wall 18, and tightened to draw the body of switch 11 and an apertured spacer 21, of elongate rectangular shape, against the inside surface of wall 18. Outwardly extending from stem 19 is a manually actuable toggle lever 24. At an opposite end wall 26 of cover 16, another aperture 28 is provided through which a cable 30 of wires 14 is passed.

Switch component 11 (FIG. 5) may be a separately manufactured, standardized, general purpose switch having a preassembled switch body 31 including an internally mounted switching mechanism (operated by lever 24) and internally mounted switch contacts. A plurality of substantially rigid, electrical connection prongs 32 are connected internally of body 31 to the switch contacts and are disposed to extend outwardly from body 31 in spaced-apart parallelism.

The number of prongs 32 will depend on the number and function of internal switch contacts. For example, a triple pole, single throw switch is shown having six prongs 32*a,* 32*b,* 32*c,* 32*d* and 32*e.* As more fully explained herein, the length of prongs 32 vary in order to match the unique placement of recesses 13 on base 12. The prong length may be varied by selectively cutting off the prong ends of a commercially available component 11 (supplied with prongs of equal length), but preferably component 11 is manufactured in the first instance with the proper prong length. A bevel may be formed at each prong end, such as bevel 34 of prong 32*a,* to point the prong ends in order to facilitate the assembly of component 11 with base 12.

Base 12 (FIGS. 1–4) in this embodiment is formed in two parts, a principal base part 12*a* and a subbase part 12*b,* each preferably being die molded from a dielectric material. Any of the various high-impact dielectric plastics commonly used in the manufacture of electrical insulator components is suitable. Part 12*a* provides the principal mounting structure for terminals 14 and component 11. Terminal receiving recesses 13 (one for each of switch prongs 32) are preferably arranged in a cluster on part 12*a,* defined by a generally upstanding, open-cell, stepped honeycomb-like structure arising from an integral platform portion 36 which may be of any suitable shape and is here formed with a rectangular perimeter that is elongate in one dimension. The honeycomb-like structure is stepped (FIG. 2) at the top or upper surfaces that define the openings of recesses 13, starting from an uppermost elevation adjacent forward end 38 of base 12 and then descending downwardly toward a lowermost elevation adjacent a rear end 40 of the base 12. A separate one of recesses 13 is provided from each of prongs 32*a–e,* and thus six recesses 13 are provided here, identified on part 12*a* by embossed numbers, #1 through #6 that ultimately serve to identify the associated terminals 14.

A plurality of prong-receiving, spaced apart apertures 42 (FIGS. 1, 2 and 4) are also formed on base part 12*a,* one for each recess 13, with each aperture 42 disposed to extend from a surface portion 44 (FIG. 2) to an interior sidewall of an associated one of recesses 13. Surface portion 44 defines an innermost wall of a switch body receiving recess 46, (FIGS. 2 and 5), wherein recess 46 is further defined by an upper surface portion 48, a pair of mutually opposing side surface portions 50 and 52 and a lower surface portion 54 provided by the herein more fully described base part 12*b.*

Figure 1:
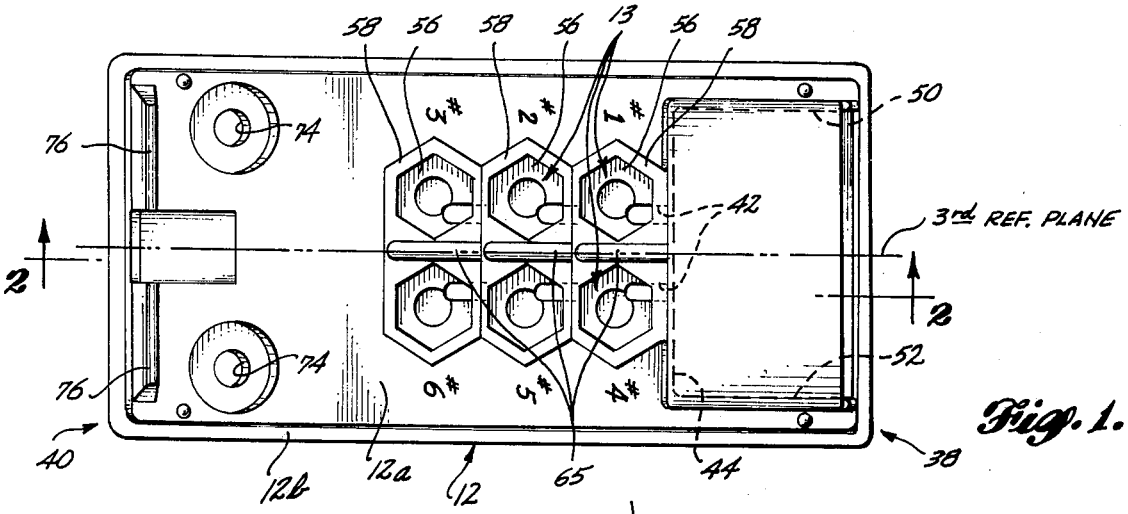
FIG. 1 is a top plan view of a base that forms a part of the terminal block assembly in accordance with the present invention.
Figure 2:
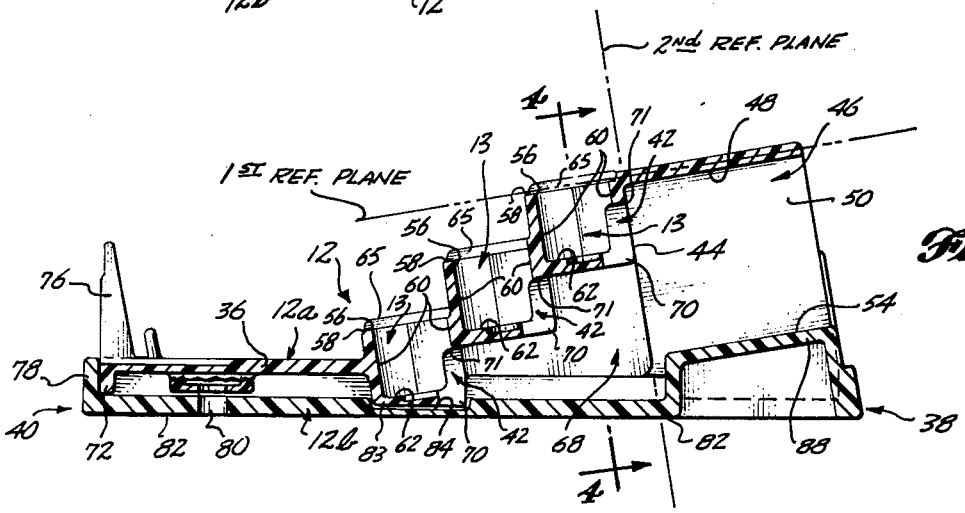
FIG. 2 is a cross sectional view of the base taken generally along section lines 2—2 in FIG. 1.

To assist in locating recesses 13, apertures 42 and the associated structure, a set of three orthogonal, imaginary planes are defined on base part 12*a,* best shown in FIGS. 1 and 2 to include 1st, 2nd and 3rd reference planes. The structure defining recesses 13 is disposed to one side of both the 1st and 2nd reference planes. The stepped openings 56 (FIGS. 1 and 2) of the recesses 13 are defined by peripheral planar land portions 58 that lie parallel to the 1st reference plane, with the interior sidewall 60 (FIG. 2) of each recess extending inwardly of the base, substantially perpendicularly to the 1st reference plane. Sidewalls 60 of recesses 13 terminate at bottom walls 62 (FIG. 2) that lie parallel to the 1st reference plane. Surface portion 44 (of switch body receiving recess 46 as shown in FIG. 2) lies parallel to the 2nd reference plane, while surface portions 48, 50, 52 and 54 all extend substantially perpendicularly to the 2nd reference plane and on the side thereof opposite recesses 13.

The structure defining recesses 13, apertures 42, and recess 46 may be tilted, as best shown in FIG. 2, relative to the plane of portion 36 so that the switch stem 19 and lever 16 (as shown in FIG. 8) are inclined away from the supporting surface on which the assembly is mounted and are thus more accessible.

Certain of recesses 13, such as the recesses designated #1 – #3 and recesses designated #4 – #6 (FIGS. 1 and 2), form geometrically ordered sets. Recesses #1 and #4 define the first recesses of their respective sets and are disposed proximate to the 1st and 2nd reference planes, and succeeding members of each set, #2 through #3 of one set and #5 through #6 of the other set, are spaced at incrementally increasing distances from the 1st reference plane, and incrementally increasing distances from the 2nd reference plane. This results in the stepped configuration and allows a plurality of switch prongs, when arranged such as prongs 32*a, b, c* or 32*d, e, f* (FIG. 5), in a plane parallel to the 3rd reference plane, to be received in individual ones of recesses 13 without obstructing an adjacent recess of the same set. Also, the incremental spacing between the planar land portions 58, physically spaces and thus electrically isolates the connections of wires 15 to terminals 14 as best shown in FIG. 8.

Prong receiving apertures 42 (FIG. 2) are correspondingly arranged at incrementally increasing distances from the 1st reference plane and extend substantially perpendicularly to the 2nd reference plane between surface portion 44 and recess sidewalls 60, entering sidewalls 60 at a location below openings 56 defined by land portions 58.

Figure 10:
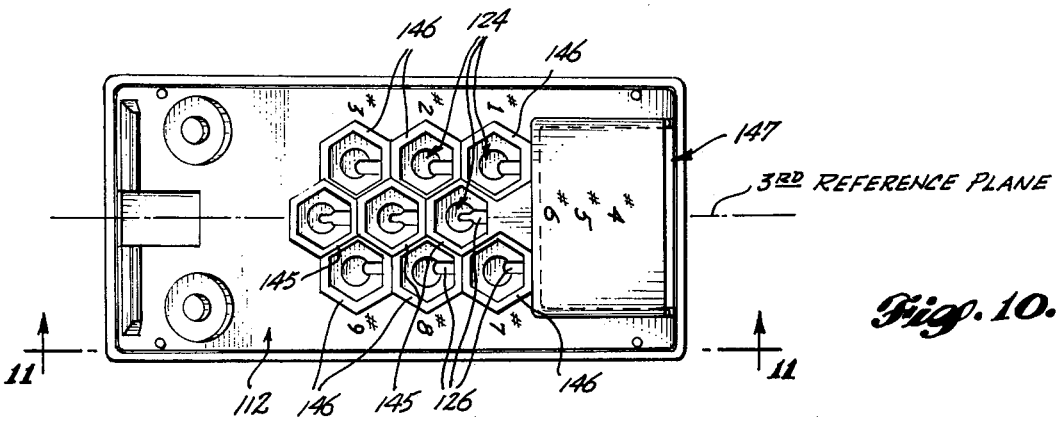
FIG. 10 is a top plan view of a base, similar to the base shown in FIGS. 1–4, however having an alternative arrangement of the terminal receiving recesses and prong receiving apertures for accommodating a switch having a correspondingly altered prong configuration.
Figure 11:
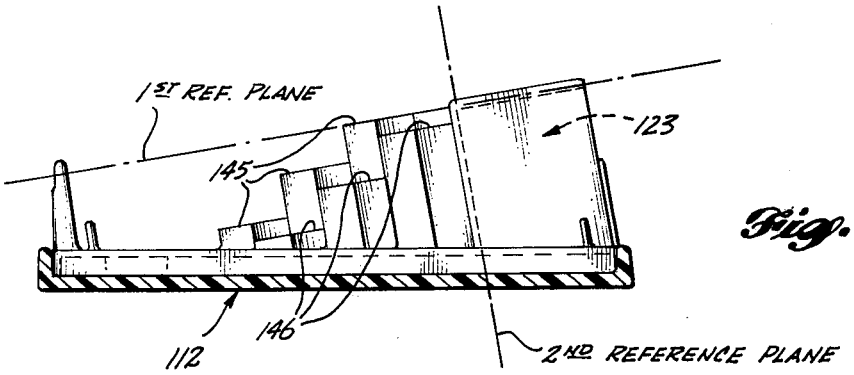
FIG. 11 is a cross sectional view taken along section lines 11—11 in FIG. 10.

Each of the two sets (#1 – #3 and #4 – #6, respectively) of stepped receses 13 in FIGS. 1 & 2, have corresponding portions disposed equidistantly from and on opposite sides of the 3rd reference plane. Additional sets of stepped recesses, each set lying equidistantly from the 3rd reference plane, may be provided as shown in FIGS. 10 and 11 and described more fully herein.

Certain of recesses 13 may be arranged with land portions 58 in a common plane, such as represented here by the pairs of recesses #1 and #4, #2 and #5, and #3 and #6. Openings 56 in these coplanar land portions are preferably, separated by raised barriers 65 (FIGS. 1, 2 and 4), integral with the molded structure of base part 12*a* and serving to electrically isolate the wire connections to those terminals 14 disposed on opposite sides of barriers 65.

Recess bottom walls 62 are disposed at an equal distance below the land portions 58 that define the associated recess openings 56. Similarly, apertures 42 and the switch prongs 32 received therein are located so that prongs 32 reside at an equal distance above bottom walls 62 and at an equal distance below the land portions 58. As described herein these features allow a standardization of the dimensions of terminals 14.

Parts 12*a* and 12*b* are molded in dies that press the plastic material into a thin-wall structure. In the case of base part 12*a*, the thin-wall molding produces a hollow shell configuration in which the regions 66 of base part 12*a* that underlie recesses 13 and regions 68 that underlie apertures 42 are void of material (See FIGS. 2, 3 and 4). To facilitate the formation of apertures 42, a lower die section may be constructed so as to provide upstanding, spaced apart, parallel, stepped rectangular die elements (not shown) that protrude upwardly into regions 68 of the base part 12*a*, piercing corners 70 (FIG. 2) of the bottom and sidewalls 62 and 60, respectively, of each of recesses 13, and interengaging complemental, die elements that extend downwardly from an upper die section and form recesses 13. These interengaging die sections that mate at corners 70 to displace the molded material thereat and to thereby form apertures 42 with an irregular-shape (FIG. 5) in sidewalls 60 and in the adjoining portion of the bottom walls 62. The upper extremity 71 (FIG. 2) of each such irregularly-shaped aperture 42 is spaced above bottom wall 62 and below the opening 56 in land portion 58 of the associated recess 13.

The lower margin of platform portion 36 (FIGS. 2, 3 and 4) of base part 12*a* is shown to be provided with a downwardly depending flange portion 72 that is complemental to subbase part 12*b*. Mounting holes 74 (FIG. 1) are provided adjacent rear end 40.

A pair of spaced apart, upstanding cable guide and cover support portions 76 (FIGS. 1, 2, 7 and 8) are integrally molded onto base part 12*a*, adjacent rear end 40, for routing cable 30 therebetween and supportively engaging an interior surface of end wall 26 of cover 16.

Figure 3:
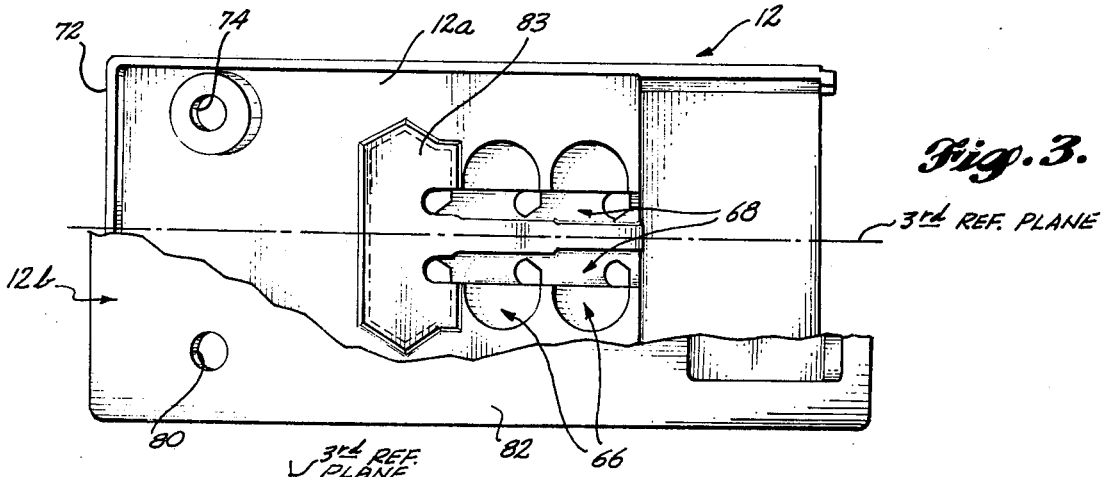
FIG. 3 is a bottom plan view of the base shown in FIGS. 1 and 2, with portions thereof cut away for clarity.
Figure 4:
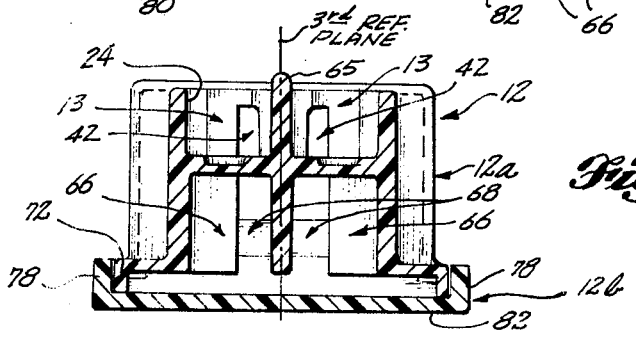
FIG. 4 is another cross sectional view of the base taken generally along section lines 4—4 in FIG. 2.

Subbase part 12*b* (FIGS. 2 and 4) is a generally flat piece having a rectangularly shaped perimeter, elongate in one dimension and having an upturned flange portion 78 along the upper margin that is complemental to and receives in nesting relationship, the downwardly depending flange portion 72 of part 2*a* (FIG. 2). A pair of holes 80 provided in part 12*b*, in registration with holes 74 of part 12*a*, serve as a means for mounting the assembly to a supporting structure. Alternatively, the lower surface 82 of part 12*b* may be provided with a strip of contact adhesive (not shown) for attachment in that manner. As shown in FIGS. 2 and 3, the lowermost portion 83 of the structure on part 12*a* that defines recesses 13 may protrude below the lowermost extremities of flange portion 72, thus requiring the formation of a complemental, shallow depression 84 (FIG. 3) in the upper surface 86 of part 12*b* to accommodate portion 83. A raised bench portion 88 (FIG. 2) is provided in part 12*b* adjacent the forward end 38 of base 12 to define the above-mentioned lower surface portion 54 of recess 46.

As shown in FIG. 6, each of terminals 14 includes a pair of prong gripping elements, at least one of which is electrically conductive, disposed adjacent opposed upper and lower, longitudinal surfaces of the associated switch prong, here illustrated by prong 32*d*. A nut member 90 of an electrically conductive metal provides one gripping element and is disposed adjacent the bottom of the recess 13 underlying prong 32*d*. The other element is a spacer member 92, also of electrically conductive metal, that is positioned adjacent opening 56 of the recess 13 so as to overlie prong 32*d*. A central hole 93 in spacer member 92 is aligned with the threaded aperture in nut member 90. To urge these elements into gripping relationship with the interposed switch prong 32*d*, a screw member 94, of electrically conductive metal, is inserted through spacer hole 93 which has a clearance fit with the shank 95 of member 94, past prong 32*d* which is disposed to one side of the shank 95, and into threaded engagement with nut member 90. Tightening of screw member 94, with a driver tool, forces spacer member 92 (by means of screw head 96) toward member 90 thereby gripping the interposed prong. The gripping force also assures positive electrical contact between the elements of terminal 14 and prong 32*d*.

The upper surface of spacer member 92 and the lower surface of screw head 96 serve to receive and electrically and mechanically connect a bifurcated lug 98 or other terminus of one of lead wires 15 to the terminal 14. Thus, screw member 94 simultaneously effects the mechanical gripping of switch prong 32*d* and the connecting of the lead wire 14.

To resist the rotation of members 90 and 92, especially nut member 90, during tightening of the screw member 94, members 90 and 92 and recesses 13 are preferably formed with complemental hexagonal sidewalls. Any regular, polygonal shape will do, but the hexagon shape allows the use of standardized hexagonal nuts and spacers. The relative dimensions of recesses 13 and terminals 14 are selected to provide a slight friction fit to temporarily retain the members 90 and 92 in place during assembly. This may be achieved by forming a slight boss portion (not shown) along one of the hexagonal segments of sidewall 60 of each recess 13 to frictionally engage the corresponding exterior hexagonal segment of members 90 and 92 as they are inserted into the recess 13 through opening 56 (FIG. 5). Bottom wall 62 of each recess 13 may be provided with a central, shallow circular depression 63 (FIGS. 5 and 6) for accommodating a slight overrun of the end of the screw member shank 95 when threadedly engaged with nut member 90. The surfaces of members 90 and 92 that grip prongs 32 may be knurled for improved mechanical securement of and improved electrical contact with the prongs. Similar knurling may be provided on the upper surfaces of spacer members 92 and the lower surfaces of screw head 96 for connecting lugs 34 to the terminals 14.

During assembly, base parts 12*a* and 12*b* are permanently secured together by nesting part 12*a* in part 12*b* as described above and adhesively bonding the complemental flange portions 72 and 78 to yield the subassembly shown in FIGS. 1 through 4. Next, the individual nut members 90 of terminals 14 are inserted into recesses 13 such that each nut member 90 seats against the recess bottom wall 62 (FIG. 6). Switch component 11 is now inserted, prongs first, into recess 46 (FIG. 5) with the pointed ends of prongs 32 being received by the complementally arranged apertures 42 (FIG. 5). Insertion continues until body 31 of component 11 is received in recess 46, with the ends of prongs 32 being guided through apertures 42 and over the upper surfaces of nut members 90. The limit to this insertion may be the abutment of body 31 against the innermost surface portion 44 of recess 46, or the abutment of the pointed ends of one or more of prongs 32 against the remote portions of sidewalls 60 of recesses 13.

As a result of this insertion step, portions of prongs 32 adjacent their respective ends reside in recesses 13, overlying nut members 90 and to one side of the threaded apertures of members 90. To achieve this interrelationship, the lengths and spacing of prongs 32 are selected to complement the above-described geometrical ordering of the locations of recesses 13 (and their associated apertures 42) on base part 12*a.* Thus the lengths of the prongs vary according to their elevational position on body 31 (as shown in FIG. 5) with the shortest prongs (prongs 32*a* and 32*d*) being aligned with those recesses (identified as #1 and #4 in FIG. 1) closest to the switch body 31 when it is seated in recess 46. The increasingly longer prongs 32 are similarly aligned with the increasingly more remote ones of recesses 13.

Although it is not necessary for the exterior surfaces of component body 31 to abut the interior surface portions of body receiving recess 46 (see FIGS. 7 and 8), such abutment of the switch body 31 with one or more of surface portions 44, 48, 50, 52 and 54 (best shown in FIGS. 1–3) does afford additional structural support and restraint (in the directions transverse to prongs 32) of component 11 when mounted on base 12. Thus in this embodiment and as shown in FIG. 8, the upper and lower surface portions 48 and 54 of recess 46 abut and restrain upper and lower surfaces of body 31.

After the insertion of component 11 spacer members 92 (FIGS. 5 and 6) are inserted into recesses 13, with the lower surface of each member 92 resting on the upper longitudinal surface of the associated prong 32 and with the upper surface of each member 92 lying substantially flush with the associated recess land portion 58.

Screw members 94 (FIGS. 5 and 6) are now inserted through spacer member holes 93 and threadedly secured into the associated nut members 90, thereby mechanically gripping prongs 32 and physically securing the switch component to the assembly. Withdrawal of component 11 is resisted by the abutment of members 90 and 92 (now longitudinally fixed on prongs 32) against the portions of recess sidewalls 60 that are adjacent apertures 42 and lie transverse to prongs 32.

In this particularly completed form, the transfer switch assembly is ready for installation, which as above described merely involves the attachment of base 12 to a supporting structure and the connection of wire lugs 98 to terminals 14 (by loosening and then retightening screw members 94) and finally the mounting of cover 16. Wires 15 may be threaded through cover aperture 28 (FIGS. 7 and 8) prior to the attachment of lugs 98. With the rear (end wall 26) of cover 16 tilted upwardly, toggle lever 24 and stem 19 are passed through aperture 17 so that cover 16 can be slid rearwardly until end wall 26 clears upstanding base portions 76. At this point the rear end of the cover is pressed downwardly with cable 30 slipping between base portions 76. Nut 22 is tightened against front end wall 18 of cover 16 to complete the installation.

Figure 9:
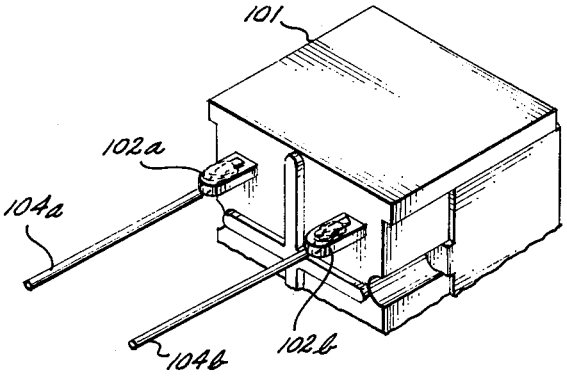
FIG. 9 illustrates an alternative configuration of the electro-mechanical switch component.

With reference to FIG. 9, an alternative construction of the switch component (corresponding to component 11 in FIG. 5) is illustrated to include switch body 101 which is provided with a plurality of spaced-apart, relatively short solder lugs 102*a,* 102*b,* etc. Some commercially available switch components are supplied in this configuration, and it is necessary to provide the elongate, substantially rigid prongs as shown for component 11 in FIG. 5. For this purpose, extension prongs 104*a,* 104*b,* etc. (corresponding to prongs 32 in FIG. 5) are electrically and mechanically bonded to the lugs 102*a,* 102*b,* etc. by soldering or other suitable means.

With respect to FIGS. 10 and 11, an alternative recess configuration is illustrated for a base 112, similar to the above-described base 12, however providing in this instance a cluster of nine terminal receiving recesses 124 and associated prong receiving apertures 126. Using the same set of 1st, 2nd and 3rd reference planes shown above in connection with FIGS. 1–4, it will be observed that recesses 124 include three goemetrically order sets: a first set consisting of recesses designated #1 – #3, a second set consisting of recess #4 – #6, and a third set consisting of recesses #7 – #9. Each of these sets exhibits the same geometrical relationships to the reference planes as the sets (#1 – #3 and #4 – #6) of recesses 13 on base 12 of FIGS. 1–4. On base 112 however, a third and centrally located set of recesses has been added, bisected by the 3rd reference plane, and lying between the spaced apart recess sets. The land portions 145 (FIG. 11) of the centrally disposed set of recesses #4 – #6 are slightly elevated with respect to the corresponding land portions 146 of sets #1 – #3 and #7 – #9 so as to provide electrical isolation between the adjacent wire lugs (not shown for this embodiment).

The switch component (not shown) adapted for insertion into a switch body receiving recess 147 of base 112, is similar to switch component 11 of FIG. 5, but is modified to include the addition of a centrally disposed set of prongs for cooperation with the central set (#4 – #6) of recesses 124 and the associated apertures 126.

Accordingly it will be appreciated that the formation and arrangement of the terminal receiving recesses and the associated prong receiving apertures on the dielectric base, are not limited to the particular configurations disclosed here. Within practical limits, any number of terminal receiving recesses, associated apertures and switch prongs may be provided according to the teachings herein. Furthermore, it will be readily apparent that numerous other changes and modifications may be made to the hereinabove disclosed embodiments without departing from the spirit of the invention.

For example, the dimensions of terminal receiving recesses 13 (FIGS. 1–8) and recesses 124 (FIGS. 10 and 11) are preferably identical or substantially identical to accommodate standard size nut and spacer members 90 and 92 (FIG. 6). However, such standardization is not essential, and the terminal receiving recesses may for example be provided with different depths between the openings thereof and the bottom walls (openings 56 and bottom walls 62 in FIG. 2). In such case, spacer members of different heights may be used to provide the desired flush relationship between the upper surface of the spacer member and the corresponding land portion as shown by member 92 and land portion 58 in FIG. 6.

Although, the terminal receiving recesses, such as recesses 13 in FIG. 1, are provided with a hexagonal shape, this is only one possible configuration, and in general the reference to the honeycomb-like structure is intended to include cell-like recesses of any suitable cross section (when taken parallel to the first reference plane), such as circular, irregular or regular polygonal, and composites of arcuate and straight segments.

What is claimed is:

1. An assembly of an electrical component and a terminal block, comprising:

an electrical component having a body and a substantially rigid electrical connection prong mechanically affixed to said body and projecting outwardly therefrom;

terminal connection means;

a base including structure formed of dielectric material that defines a terminal receiving recess and a prong receiving aperture, said terminal receiving recess having an opening through which said terminal connection means is inserted and having an interior wall extending inwardly of said base from said opening, said body of said component being mounted adjacent a surface of said base that is spaced from said recess and said prong receiving aperture being sized and positioned to extend from said surface and enter into said terminal receiving recess through said interior wall thereof at a location spaced inwardly from said opening, said prong being disposed in said prong receiving aperture so that a free end of said prong protrudes into said terminal receiving recess from said aperture in said interior wall;

said terminal connection means being disposed in said terminal receiving recess and having a pair of prong gripping elements, at least one of which is electrically conductive, receiving said prong therebetween, and having tightening means coacting with said prong gripping elements for drawing said elements into mechanical and electrical engagement with said prong, said terminal connection means being sized and oriented with respect to both said terminal receiving recess and said prong receiving aperture so as to anchor said prong in said recess and thus secure said component to said base.

2. The assembly set forth in claim 1, wherein said tightening means and one of said prong gripping elements include lead wire connection means adapted for electrically and mechanically connecting an end of a lead wire to said terminal connection means.

3. The assembly set forth in claim 1, wherein said component body has at least one additional substantially rigid electrical connection prong mechanically affixed thereto and disposed in spaced apart parallelism with the first mentioned said prong, said base structure defining an additional terminal receiving recess having an opening and an interior wall and defining an additional prong receiving aperture that receives said additional prong, and an additional terminal connection means disposed in said additional recess and having a pair of prong gripping elements and coacting tightening means for mechanically and electrically engaging said additional prong located therein.

4. The assembly set forth in claim 3, wherein said structure defining said terminal receiving recesses is further characterized as defining a planar land portion surrounding said opening to each of said recesses, and said terminal connection means including means disposed substantially coplanar with said land portions for receiving and connecting a terminus of a lead wire.

5. The assembly as set forth in claim 4, wherein said land portions surrounding said recess openings are coplanar, and said base having further structure defining a raised barrier disposed between said openings.

6. The assembly set forth in claim 3, wherein each of said terminal receiving recesses extends inwardly of said base from said opening and terminates at a bottom wall, said interior wall of each of said recesses being a sidewall which extends between said opening and said bottom wall, and said prong receiving apertures and component prongs being oriented such that said sidewalls of said recesses are substantially transverse to the longitudinal dimensions of the prongs.

7. The assembly set forth in claim 6, wherein one of said prong gripping elements of each of said terminal connection means is disposed between said bottom wall of an associated one said recesses and the prong therein, and the remaining said prong gripping element is disposed between such prong and said recess opening.

8. The assembly set forth in claim 7, wherein one of said prong gripping elements of each of said terminal connection means is provided with an internally threaded bore, and said tightening means of each of said terminal connection means includes a screw member cooperatively threadedly engaging said threaded bore of said element.

9. The assembly set forth in claim 8, wherein said recesses, terminal connection means, prong receiving apertures, and component prongs, are arranged such that each of said prongs extend transversely adjacent to said threaded shank of said screw of the associated terminal connection means.

10. The assembly as set forth in claim 5, wherein the planes of said planar land portions of said terminal receiving recesses are different.

11. The assembly as set forth in claim 10, wherein the different planes of said planar land portions are parallel.

12. The assembly as set forth in claim 1, wherein said prong gripping elements of said terminal connection means include a nut and a spacer inserted into said terminal receiving recess, said nut having an internal threaded bore and the axis of said bore extending substantially transversely to said prong, said terminal receiving recess having structural means for restraining said nut against rotation, said spacer inserted in said recess on an opposite side of said prong from said nut and said spacer having a bore aligned with the threaded bore of said nut, and said tightening means including a screw having a clearance fit with the bore in said spacer and being cooperatively threaded with said bore of said nut for gripping said prong between said nut and spacer.

13. The assembly as set forth in claim 12, wherein said interior wall of said recess is generally transverse to said prong and wherein said nut and spacer of said terminal connection means include abutment portions that abut said interior wall of said recess and thereby secure said prong against withdrawal from said base.

14. The assembly as set forth in claim 1, wherein said base includes further structure defining a body receiving recess that matingly receives said component body.

15. In an assembly of a terminal block and an electrical component of the type having body and a plurality of substantially rigid electrically conductive prongs extending in spaced apart parallelism outwardly from said body, the improvement in said terminal block comprising:

a base having structure formed of a dielectric material defining a cluster of similarly formed terminal receiving recesses each having an opening in an upper surface of said base and having an interior sidewall extending into said base from said recess opening and terminating at a bottom wall of said recess, said sidewalls of said recesses being substantially perpendicular to a 1st reference plane defined on said base, said base further having a surface portion lying substantially parallel to a 2nd reference plane that is orthogonal to said 1st reference plane and that is located on said base to one side of said cluster of recesses, said base having further structure formed of dielectric material defining a plurality of prong receiving apertures each extending inwardly from said surface portion and each entering a separate one of said recesses through said sidewall thereof, said component prongs being disposed in said apertures and being positioned so that end portions of said prongs protrude into individual said recesses; and a plurality of terminal means individually disposed in separate ones of said recesses, each of said terminal means mechanically gripping and electrically contacting the end portion of the one of said prongs residing within a corresponding one of said recesses.

16. The terminal block as set forth in claim 15, wherein each of said terminal means include a nut, a screw and a spacer inserted into the associated said terminal receiving recess, said nut having an internal threaded bore and the axis of said bore extending substantially transversely to the associated said prong, each said terminal receiving recess having structural means for restraining said nut and spacer against movement parallel to said 1st reference plane, said spacer inserted in said recess on an opposite side of said prong from said nut and said spacer having a bore aligned with the threaded bore of said nut, and said screw having a clearance fit with the bore in said spacer and being cooperatively threaded with said bore of said nut drawing said nut and spacer toward each other gripping said prong between said nut and spacer.

17. The terminal block set forth in claim 15, wherein said cluster of recesses is disposed to one side of said 1st reference plane, and at least certain of said recesses are arranged to form a first set in which corresponding portions of the recesses of said first set are disposed at different distances from said 2nd plane and wherein the associated apertures that enter into the recesses of said first set are disposed with corresponding portions at different distances from said 1st plane.

18. The terminal block of claim 17, wherein said first set of recesses commences with a first recess disposed proximate said 2nd reference plane and succeeding recesses of said first set are disposed with corresponding portions at incrementally increasing distances from said 2nd reference plane.

19. The terminal block of claim 18, wherein said first set of recesses are disposed with corresponding portions equidistant from a 3rd reference plane defined on said base, said 3rd reference plane being orthogonal to said 1st and 2nd reference planes.

20. The terminal block of claim 19, wherein corresponding portions of said apertures associated with said first set of recesses are disposed at incrementally increasing distances from said 1st plane commencing with a first aperture associated with said first recess of said first set being located proximate said 1st reference plane, and those succeeding apertures which are associated with said succeeding recesses of said first set having corresponding portions located at incrementally increasing distances from said 1st plane.

21. The terminal block of claim 20, wherein corresponding portions of those of said apertures which are associated with said first set of recesses are disposed equidistantly from said 3rd reference plane.

22. The terminal block of claim 21, wherein said openings of said recesses of said first set are defined in stepped planar surface portions commencing with the opening of said first recess in a planar surface portion that lies parallel and proximate to said 1st reference plane and with said openings for succeeding recesses in said set first being defined in planar surfaces parallel to and located at incrementally increasing distances from said 1st reference plane.

23. The terminal block of claim 22, wherein the bottom walls of said recesses of said first set are disposed equidistantly from the openings of said recesses.

24. The terminal block of claim 23, wherein corresponding portions of said apertures associated with the recesses of said first set are disposed equidistantly along said sidewalls from the openings of said recesses.

25. The terminal block of claim 19, wherein at least certain other of said recesses are arranged to form a second set of recesses commencing with a first recess disposed proximate to said 2nd reference plane and with succeeding members of said second set having corresponding portions disposed at incrementally increasing distances from said 2nd reference plane, and said second set of recesses having corresponding portions disposed equidistantly from said 3rd reference plane.

26. The terminal block of claim 25, wherein the openings of said recesses of said first set and the openings of the recesses of said second set are defined by peripheral land portions lying parallel to said first reference plane, and said peripheral land portions that define the opening of at least one of the first set of recesses being coplanar with the peripheral land portions that define the opening of one of said second set of recesses.

27. The terminal block set forth in claim 26, wherein said base includes a raised barrier disposed on said land portions that are coplanar and being located between said recess openings defined therein.

28. The terminal block of claim 15, wherein said base has additional structural portions adjacent said surface portion that restrain said body of said component against displacement in a direction parallel to said 2nd reference plane.

29. The terminal block of claim 15, wherein said base has additional structural portions adjacent said surface portion defining a component body receiving recess and wherein said component body is seated therein.

30. The terminal block set forth in claim 29, wherein said base comprises a platform portion having upper and lower surfaces, and a substantially flat, subbase portion having an upper surface complemental to the lower surface of said platform portion, said structural portions that define said recesses and apertures being integrally formed with said platform portion and the lower surface of said platform portion being seated on and secured to said subbase portion.

31. The terminal block set forth in claim 30, wherein said platform portion is substantially hollow at regions thereof underlying said apertures and underlying said bottom walls of said terminal receiving recesses.

32. The terminal block in claim 30, wherein said subbase portion includes structure defining a raised bench portion, said bench portion together with structural portions integral with said platform portion defining said component body receiving recess.

33. The assembly set forth in claim 1 wherein said electrical component is a manually operable electromechanical switch.

34. The assembly set forth in claim 33 wherein said electrical component has a toggle lever supportively mounted on said body.

35. In an assembly of a terminal block and an electrical component, said electrical component being mechanically mounted on said terminal block and being of the type having a body and a plurality of substantially rigid electrical connection prongs extending in proximate but spaced apart parallelism outwardly from said body, the improvement in said terminal block comprising:

a base having a generally upstanding, open cell honeycomb-like structure having cellular recesses arranged in steps commencing with at least one such recess at an uppermost elevation adjacent a first end of said base and descending downwardly in steps therefrom to at least one such recess at a lowermost elevation adjacent a second end of said base remote from said first end, said recesses of said structure having internal wall portions defining a plurality of prong receiving apertures, one for each said recess, said apertures extending inwardly of said base from a surface thereof adjacent said first end and entering into separate ones of said recesses, said prongs of said component being disposed in said apertures with the free ends of said prongs protruding into said recesses, and a plurality of terminal connection means positioned in separate ones of said recesses for mechanically and electrically engaging the prongs therein.

* * * * *